US012111130B2

(12) United States Patent
Arnedo Vera et al.

(10) Patent No.: US 12,111,130 B2
(45) Date of Patent: Oct. 8, 2024

(54) SELF-ADJUSTING VALVE SYSTEM FOR SPORTING AIR GUNS USING PCP OR PRE-COMPRESSED AIR

(71) Applicant: GAMO OUTDOOR, S.L., Sant Boi de Llobregat (ES)

(72) Inventors: Julián Arnedo Vera, Sant Boi de Llobregat (ES); Gonzalo Velilla Sánchez, Sant Boi de Llobregat (ES)

(73) Assignee: GAMO OUTDOOR, S.L., Sant Boi de Llobregat (ES)

( * ) Notice: Subject to any disclaimer, the term of this patent is extended or adjusted under 35 U.S.C. 154(b) by 0 days.

(21) Appl. No.: 18/041,550

(22) PCT Filed: Dec. 1, 2020

(86) PCT No.: PCT/ES2020/070754
§ 371 (c)(1),
(2) Date: Feb. 14, 2023

(87) PCT Pub. No.: WO2022/117895
PCT Pub. Date: Jun. 9, 2022

(65) Prior Publication Data
US 2023/0304769 A1 Sep. 28, 2023

(51) Int. Cl.
*F41B 11/723* (2013.01)
*F41B 11/72* (2013.01)

(52) U.S. Cl.
CPC ..... *F41B 11/723* (2013.01); *F41B 11/72* (2013.01)

(58) Field of Classification Search
CPC ..... F41B 11/723; F41B 11/72
See application file for complete search history.

(56) References Cited

U.S. PATENT DOCUMENTS

2007/0151549 A1* 7/2007 Wood ..... F41B 11/723 124/73
2008/0078971 A1* 4/2008 Quinn ..... F41B 11/721 700/282
2022/0082352 A1* 3/2022 Tasyagan ..... F41B 11/723

* cited by examiner

*Primary Examiner* — J. Woodrow Eldred
(74) *Attorney, Agent, or Firm* — Stanzione & Associates, PLLC; Patrick Stanzione

(57) ABSTRACT

Of the type actuated by a trigger (9) having a support part (14), which defines a housing (1) which comprises at least one air inlet (2,12), at least one outlet (3), characterised in that it comprises:

a first body (5), as a valve, which, when in a rest position, blocks the air outlet (3);

a second body (6), as a piston, which partially encloses the first body (5), said second body (5) being blocked by the trigger (9) when in a rest position, a first elastic means (8), arranged in the housing (1), between the second body (6) and the support part (14), a slot (10), formed in the first body (5), and a pin (11), crossing the slot (10), and which fits in certain holes (13) formed in the second body (6).

13 Claims, 6 Drawing Sheets

SELF-ADJUSTING VALVE SYSTEM FOR SPORTING AIR GUNS USING PCP OR PRE-COMPRESSED AIR

Self-adjusting valve system for sporting air guns using PCP or pre-compressed air, of the type actuated by a trigger having a support part, which defines a housing that comprises at least one air inlet, at least one outlet, characterised in that it comprises: a first body, as a valve, which blocks, when in its rest position, the air outlet; a second body, as a piston, which partially encloses the first body, said second body being blocked by the trigger when in its rest position; a first elastic means arranged in the housing, between the second body and the support part; a slot, formed in the first body, and a pin, which passes through the slot and fits into holes formed in the second body; in its passive position, the first elastic means pushes the second body towards the outlet, and this second body in turn pushes the first body against the outlet and blocking it; the air pressure from the inlets is projected against the first body, thus contributing to block the outlet; and against the second body, moving such second body in the opposite direction to the outlet and said second body being locked against the trigger and when in the active position, the trigger rotates and releases the second body. The second body, by the effect of the air pressure projected towards the second body, compresses the first elastic means and moves said body in the opposite direction to the outlet. The pin moves through the slot and at the end of the stroke drags the first body in an opposite direction to the outlet, thus releasing the outlet, through which the inlet pressure air exits. When the first elastic means is decompressed, it drags the second body towards the outlet, thus blocking the trigger, and it pushes the first body towards the outlet, thus blocking the outlet.

BACKGROUND OF THE INVENTION

Different compressed air propelling systems working inside sporting guns, known as "air guns" and "air rifles", are known in the state of the art.

In the state of the art it is comprised Spanish Patent No ES2038537 "GUN PROPELLED BY A PRESSURE FLUID HAVING A DOUBLE AMMUNITION LOADING SYSTEM", of the year 1991, in the name of the same Applicant, which refers to a gun propelled by a pressure fluid and having a double system for loading ammunition, comprising a magazine which feeds ammunition, one by one, to a housing aligned with the barrel. The particular feature hereof is that said magazine is articulated by one of its ends, and that its distal end portion is located, floating, within a groove having a stop that limits the movement of said end portion being pushed by a spring. Thus, the geometric axis of the loading device, when in the loading position, becomes aligned with a housing formed in the groove, which is connected to the source of the propellant fluid. The barrel of the gun associated to the supporting body of the barrel is articulated in the same articulation plane as the magazine, so that when blocking the gun, the magazine is moved by the barrel, which stays facing the housing and is then ready for firing.

A one-piece valve is installed in this gun. In such one-piece valve, the pressure air in the tank impacts on said valve. It is known as an AF-10 valve. This valve closes the air outlet to the pellet, both upwards and downwards, by means of certain joints. The closing diameter being larger downwards than upwards, when there is pressure, the valve group tends to go downwards, the trigger being positioned there to hold such valve group. When pulling the trigger, the valve group descends, the upper joint stops closing and the air escapes towards the pellet.

BRIEF DESCRIPTION OF THE INVENTION

The present invention belongs to the field of compressed air propellant systems arranged within the sporting guns.

The nearest document is the above-cited AF-10 valve.

Such patent solves the problem of how to open and close air outlet for the pellet in a fast and efficient manner by means of a system of descent and ascent that opens and closes said outlet when pulling and releasing the trigger.

However, such system has the drawback that the closing sizes of the area of the air outlet to the pellet are quite critical, and so are the sizes of the support parts to the valve group in the bottom area of the trigger.

The present invention solves this problem by building it in two pieces, with a first body and a second body, in such a way that the first body tends to go upwards to close the outlet and the second body tends to go downwards and lean on the trigger, thus providing a much larger margin of tolerances in manufacturing the parts.

In addition, the invention comprises a slot crossed by a pin that connects the bodies. The slot is what allows the two bodies to slide with respect to one another with a certain degree of independence, so that the manufacturing tolerances do not have to be so strict.

The object of the present invention is a self-adjusting valve system for sporting air guns using PCP or pre-compressed air, of the type actuated by a trigger having a support part, which defines a housing that comprises at least one air inlet, at least one outlet, characterised in that it comprises: a first body by way of a valve, which, in its rest position blocks the air outlet; a second body by way of a piston, which partially encloses the first body, said second body being blocked by the trigger when in its rest position; a first elastic means, arranged in the housing, between the second body and the support part, and a pin that crosses the slot and fits within certain holes in the second body and which, in its passive position, is pushed by the first elastic means towards the outlet of the second body, and this in turn pushes the first body against the outlet, blocking it. The air pressure from the inlets is then projected against the first body thus contributing to block the outlet and against the second body, moving it in an opposite direction to the outlet; said second body being blocked against the trigger. And, when in the active position, the trigger rotates and releases the second body which, by the effect of the air pressure projected onto the second body, comprises the first elastic means and moves said body in the opposite direction to the outlet; the pin moves through the slot and when it reaches the end of the stroke, it drags the first body in an opposite direction to the outlet, thus releasing the outlet through which the inlet pressure air exits. When the first elastic means is decompressed, it drags the second body towards the outlet allowing the trigger to be locked, pushing the first body towards the outlet and blocking the outlet.

BRIEF DESCRIPTION OF THE DRAWINGS

In order to facilitate the explanation, this specification is accompanied by six sheets of drawings representing a specific embodiment thereof, which is provided as a non-limiting example of the scope of the present invention.

SPECIFIC EMBODIMENT OF THE PRESENT INVENTION

Figure 1:
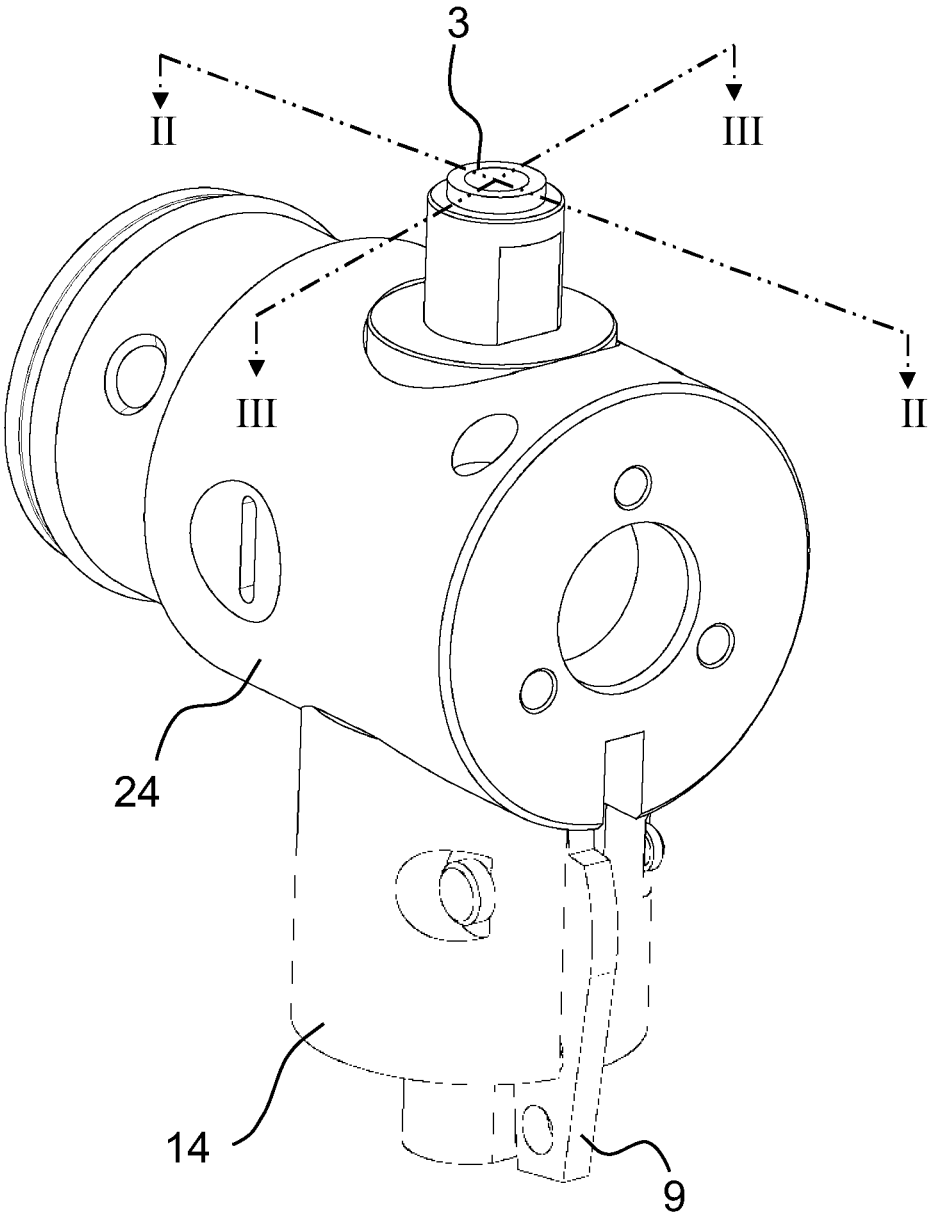
FIG. 1 is an overview, in perspective, of the object of the present invention.

FIG. 1 shows a frame 24, a trigger-support part 14, a trigger 9, an air outlet 3.

Figure 2:
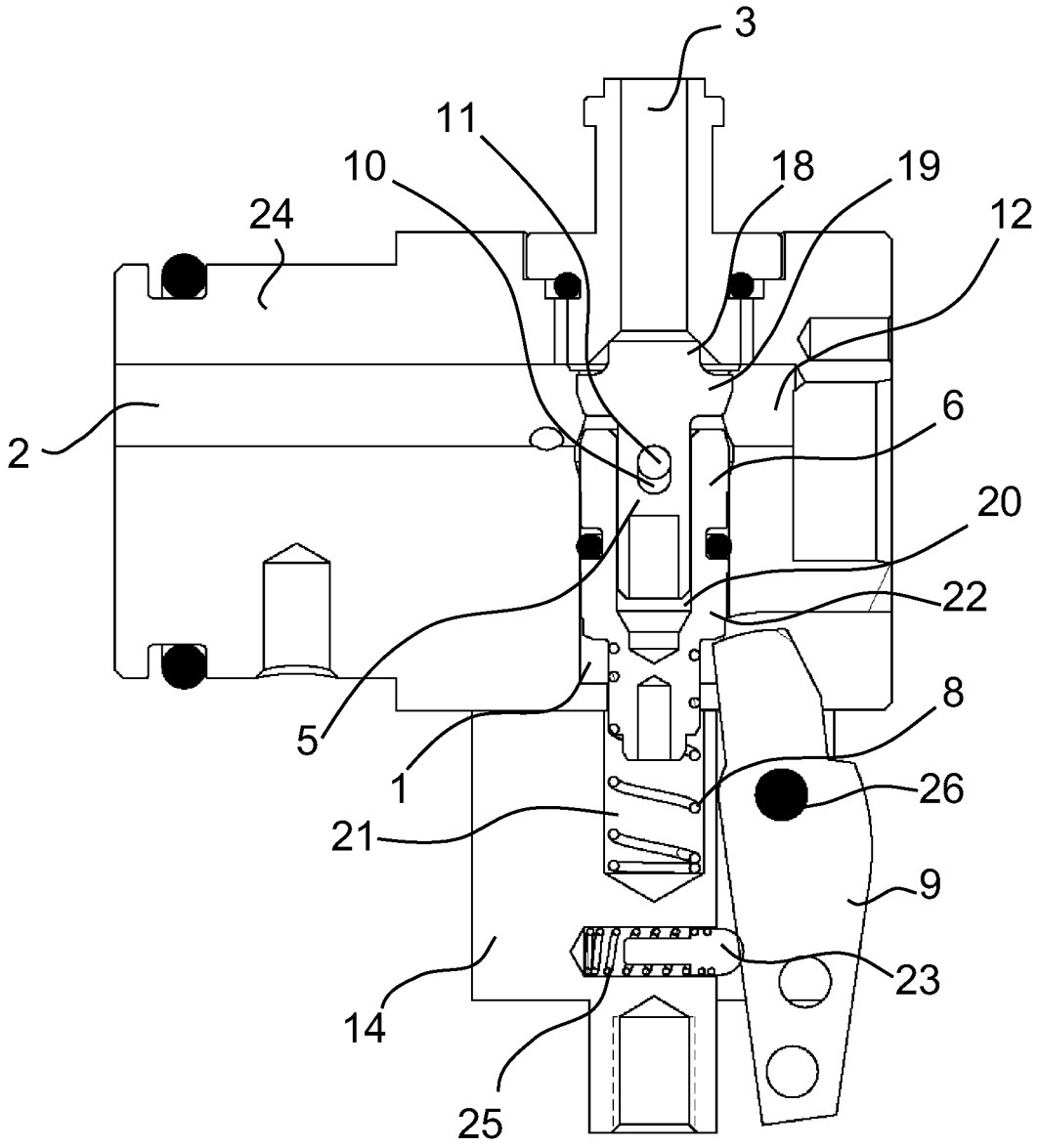
FIG. 2 is a longitudinal section along the line II-II of FIG. 1, without the second elastic means and a cusp disk blocking the outlet.

FIG. 2 illustrates the frame 24, the trigger-support part 14, the trigger 9 and its axis 26, air inlets 2,12, air outlet 3, a housing 1, a first body 5 having a cusp disk 18 and its disk 19, a second body 6 having a protrusion 22, a first elastic means 8, a slot 10 with a pin 11, a first blind hole 20, a second blind hole 21 and a return means 23 having a third elastic means 25.

Figure 3:
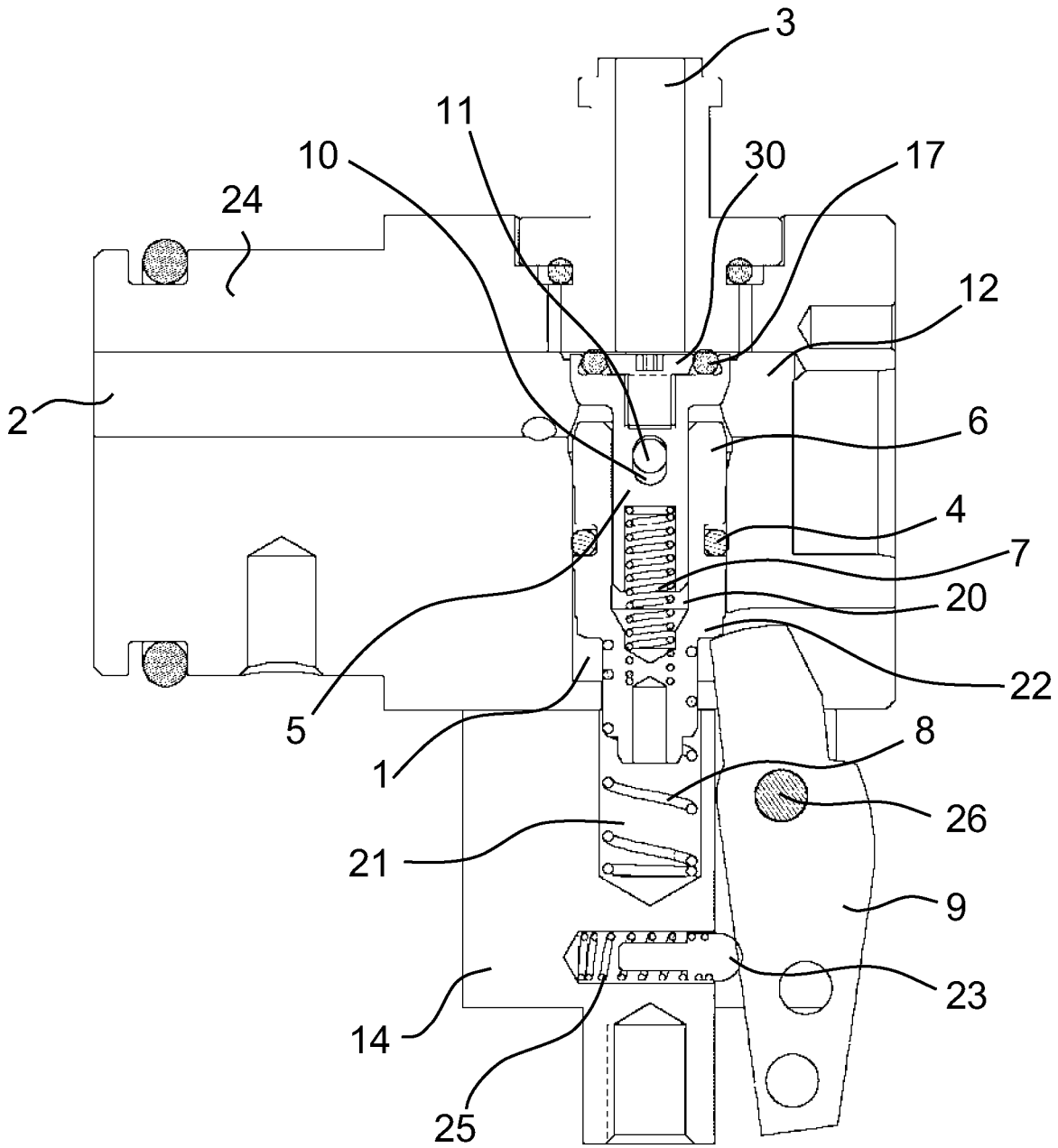
FIG. 3 is a longitudinal section along line II-II of FIG. 1 with the second elastic means and an 0-ring blocking the outlet.

FIG. 3 shows the frame 24, the trigger-support part 14, the trigger 9 and its axis 26, air inlets 2, 12; air outlet 3, housing 1, the first body 5 with its head 30 and its first joint 17, second body 6 having a protrusion 22, a second joint 4, the first elastic means 8, a second elastic means 7, slot 10 and pin 11, the first blind hole 20, the second blind hole 21 and the return means 23 with the third elastic means 25.

Figure 4:
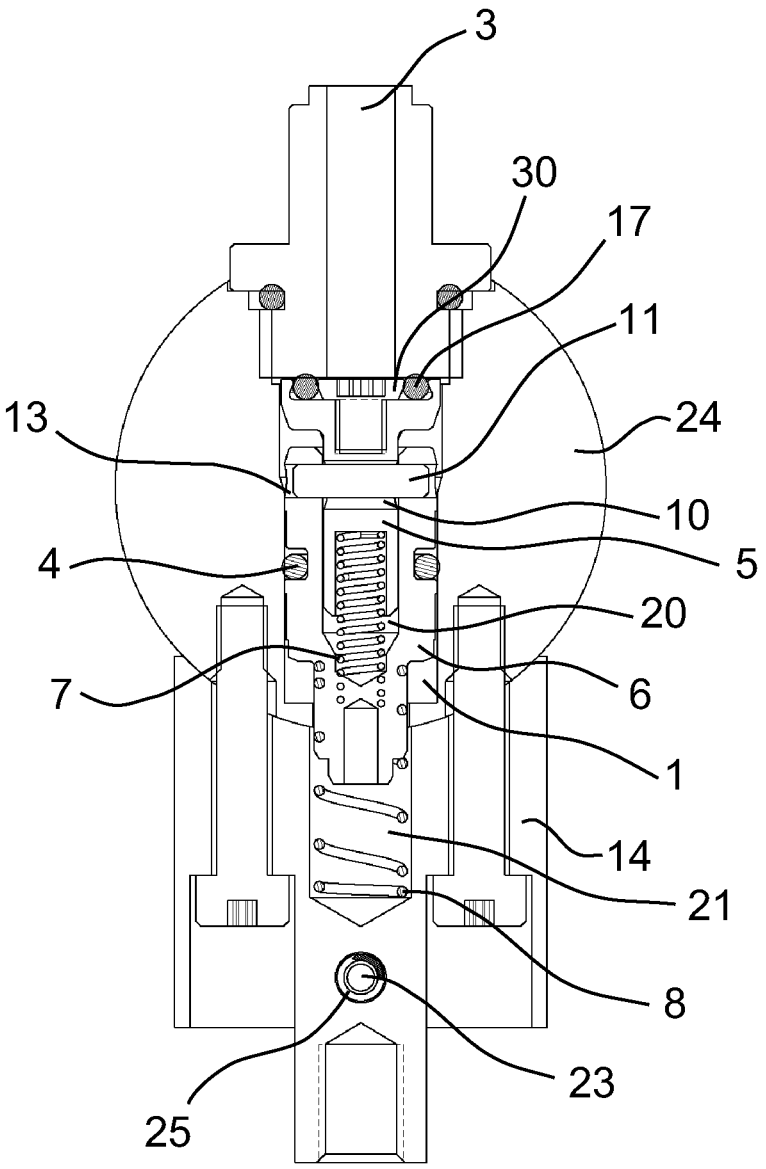
FIG. 4 is a cross-sectional section along line III-III of FIG. 1, with the second elastic means and an 0-ring blocking the outlet.

FIG. 4 shows frame 24, trigger-support part 14, air outlet 3, the housing 1, the first body 5 and its head 30 having its first joint 17, the second body 6 having holes 13, the second joint 4, the first elastic means 8, the second elastic means 7, the slot 10 and the pin 11, the first blind hole 20, the second blind hole 21, and the return means 23 having the third elastic means 25.

Figure 5:
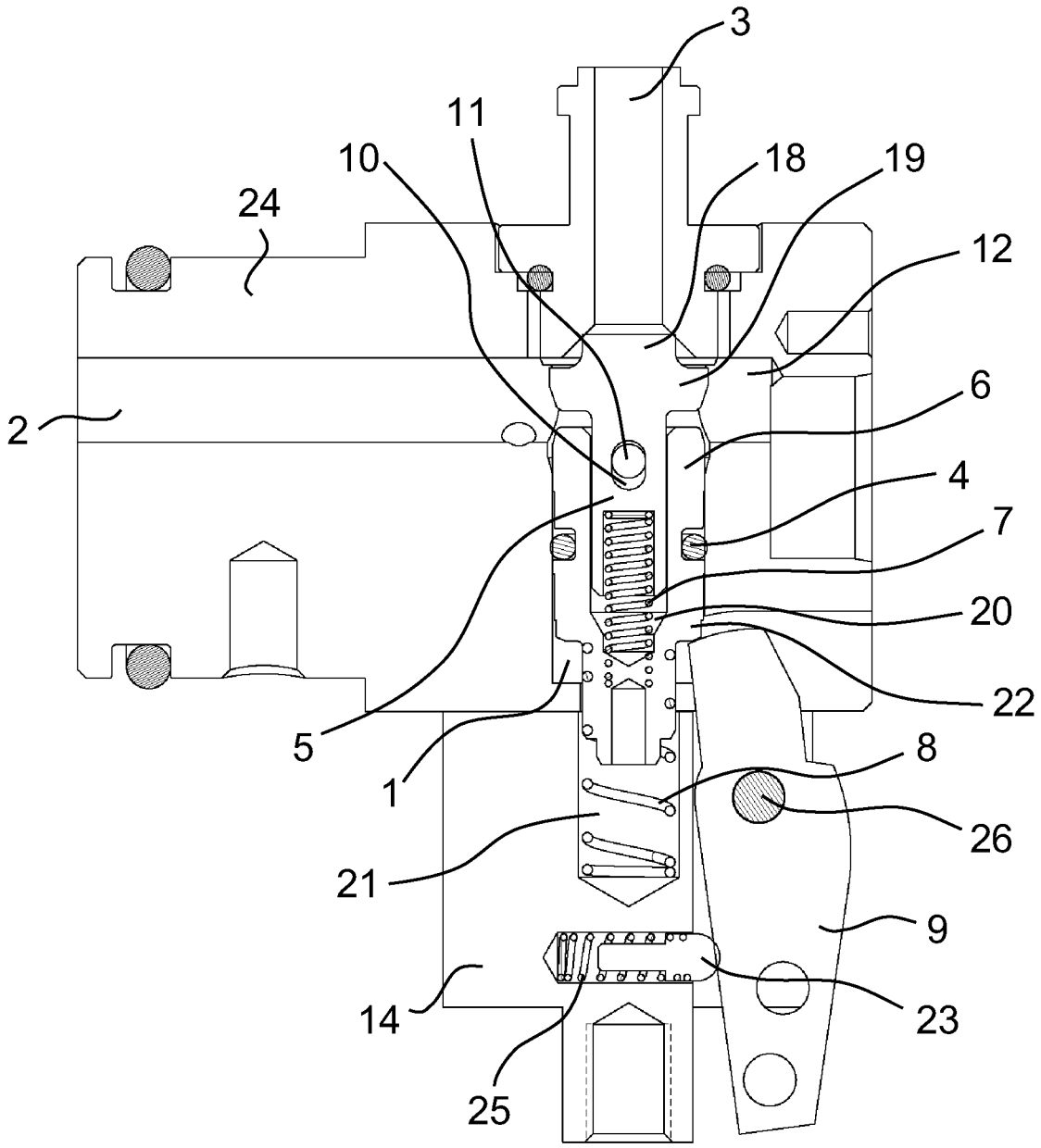
FIG. 5 is a longitudinal section along line II-II of FIG. 1 with the second elastic means and a cusp disk blocking the outlet.

FIG. 5 shows the frame 24, the trigger-support part 14, the trigger 9 and its axis 26, air inlets 2,12, air outlet 3, the housing 1, the first body 5 having a cusp disk 18 and its disk 19, the second body 6 having a protrusion 22, the second joint 4, the first elastic means 8, the second elastic means 7, the slot 10 with its pin 11, the first blind hole 20, the second blind hole 21, and the return means 23 with the third elastic means 25.

Figure 6:
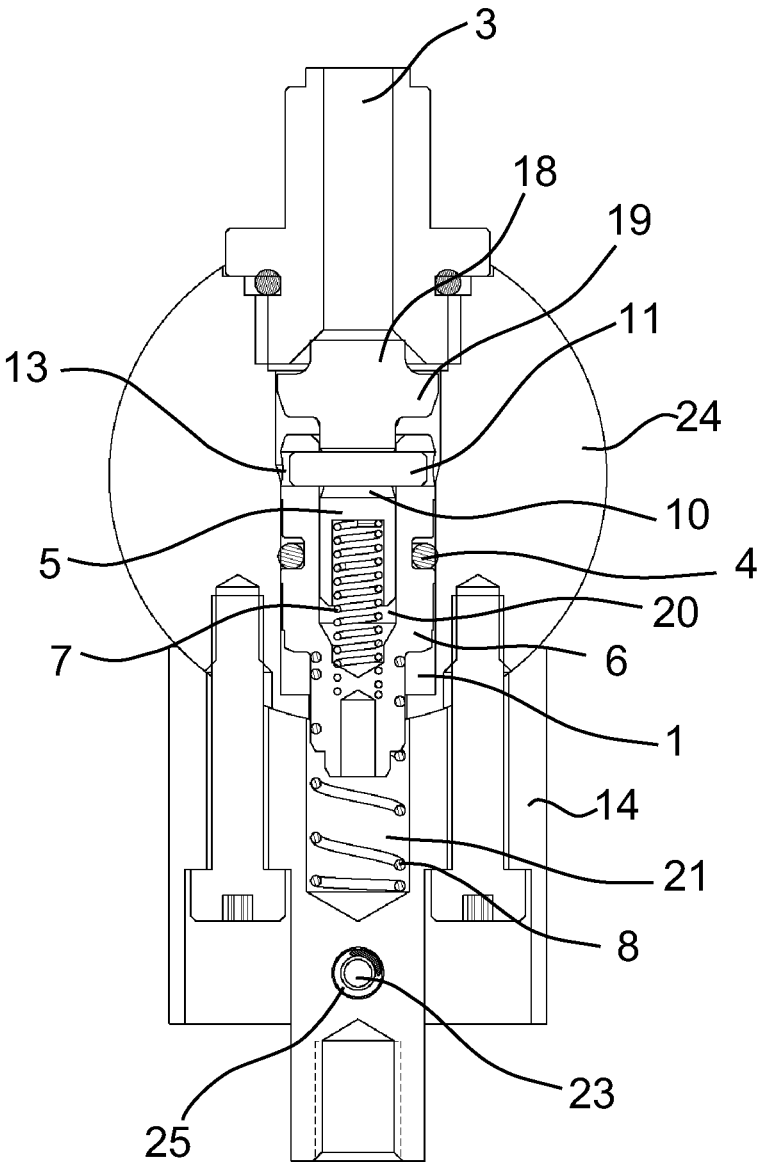
FIG. 6 is a cross-sectional cut along line III-III of FIG. 1 with the second elastic means and a cusp disk blocking the outlet.

Lastly, FIG. 6 illustrates the frame 24, the trigger-support part 14, air outlet 3, the housing 1, the first body 5 having a cusp disk 18 and disk 19, the second body 6 having holes 13, the second joint 4, the first elastic means 8, the second elastic means 7, the slot 10 with the pin, the first blind hole 20, the second blind hole 21, and the return means 23 having the third elastic means 25.

Thus, the valve system of the present invention is conceived for sporting air guns using PCP or pre-compressed air, known as air rifles and air pistols, of the type actuated by a trigger 9.

The system defines a housing 1 comprising at least one air inlet 2,12, and at least one outlet 3 of the air towards the pellet.

The system comprises a first body 5, as a valve, which blocks, when in a rest position, the outlet 3 of the air, as shown in FIGS. 2-6.

The second body 6 operates as a piston; it partially encloses the body 5. Said second body 6 is blocked by the trigger 9 when in a rest position. In fact, this is a mutual blocking, since the trigger 9 blocks the second body 6 so that said second body does not slide downwards, and the second body 6 blocks the trigger 9 so that the trigger 9 does not rotate.

The first elastic means 8 is arranged in the housing 1, between the second body 6 and the support part 14. The support part 14 serves as a support to the trigger 9 when the trigger performs the shooting and return operations.

A slot 10 has been formed in the first body 5, said un slot 10 being crossed by a pin 11, which goes through the slot 10 and fits into certain holes 13 formed in the second body 6. El slot 10 allows a certain security margin for supporting the trigger 9 and blocking the outlet 3 at the same time. The outlet 3 is released and lets out the pressure air coming from the inlets. When the first elastic means 8 is decompressed, it drags the second body 6 in the direction of the outlet 3 and allows the blocking of the trigger 9, pushing the body 6 towards the outlet 3, towards the first body 5, and blocking the outlet 3 (FIGS. 3-6).

Thus, in a passive position, the first elastic means 8 pushes the second body 6 towards the outlet 3; and the second body 6 pushes the first body 5 against the outlet 3 and blocks it. At this point, the air pressure coming from the inlets 2, 12 is projected against the first body 5, contributing to the blocking of outlet 3, and against the second body 6, which is moved in an opposite direction to the outlet 3, becoming blocked against the trigger 9.

In the active position, the trigger 9 rotates and releases the second body 6 which, by the effect of the air pressure projected in the second body 6, compresses the first elastic means 8 and pushes it in the opposite direction to the outlet 3. Next, the pin 11 moves through the slot 10 and, when the pin 11 reaches the end of the stroke, it pushes the slot 10 towards the first elastic means 8, dragging the first body 5 in an opposite direction to the outlet 3, releases the outlet 3 and lets out the pressure air from the inlets 2,12, being this same pressure air the one that separates the first body 5 from the second body 6.

El slot 10 causes the sizes or the distances to adapt, thus avoiding any strict tolerances. The air pressure then accommodates the bodies 5, 6.

When the first elastic means 8 is decompressed, it drags the second body 6 towards the outlet 3; this allows the blocking of the trigger 9 and pushes the first body 5 towards the outlet 3, blocking the outlet 3.

In other words, the pressure air separates the bodies 5, 6; the first body 5 is moved towards the outlet 3 and the second body 6 against the trigger 9.

Optionally, a second elastic means 7 may be added, which will be arranged within the first body 5, between the first body 5 and the second body 6 (FIGS. 3-6).

Said second elastic means 7 separates the first body 5 from the second body 6. When in a passive position, pushes the second elastic means, 7 pushes the first body 5 against the outlet 3, thus blocking said outlet 3.

When in the active position, the second elastic means 7 is decompressed and releases the outlet 3 letting out the pressure air from the inlets 2,12.

When the second elastic means 7 is compressed, it pushes the first body 5 towards the outlet 3, thus blocking the outlet 3.

Optionally, the first body 5 adopts a double-disk configuration (FIGS. 2 y 5-6), wherein the cusp disk 18, by way of a circular section, blocks the outlet 3 and the disk 19 is positioned outside the outlet 3 when in a passive position, serving as a guide and assuring that the outlet 3 is sealed. (FIGS. 2, 5-6).

An option to the above description is provided in FIGS. 3 and 4, where the first body 5 comprises a head 30 delimited by a first joint 17, where said head 30 is positioned opposite to the outlet 3 and blocks the outlet 3.

Depending on the model of the air gun, it may be more convenient to apply the option of the first joint 17 (FIGS. 3 - 4) or the double disk option, with the cusp disk 18 and the disk 19 (FIGS. 2, 5-6).

An additional option may also be when the second elastic means 7 is at least partly positioned in a first blind hole 20 formed in the first body 6, which facilitates the positioning of the second elastic means 7, the guiding and space is saved.

One of the manufacturing options is that the first body 5 be made of plastic material, although depending on the model of the airgun, it could be made of metal.

The first elastic means 8 may be positioned, at least partially, in a second blind hole 21 formed in a trigger support part 14, which facilitates the arrangement of the first elastic means 8, the guide and, which saves space.

To make the system more hermetic and to allow the air to separate the two bodies 5,6, a first join 4 is comprised in the housing 1, between the second body 6 and the frame 24. In this manner, the air from the inlets 2,12 cannot escape the frame 24, thus building pressure.

One manufacturing option is as shown in FIG. 2, where the second body 6 comprises a protrusion 22 connected to the trigger 9, which blocks the trigger 9 and, in turn, makes the trigger 9 block the second body 6.

In line with the above paragraph, instead of the protrusion 22, the second body 6 may be arranged to comprise a slot (not shown) connected to the trigger 9, so that the trigger 9 is caught by said slot 9 and when the trigger is rotated, it will be detached from the slot and will move the second body 6.

To facilitate the movement of the trigger 9 it has been arranged that the trigger-support part 14 comprises a return means 23 for returning the trigger 9 to its initial position.

In a practical embodiment, when the user presses the trigger 9, it rotates by the trigger axis 26 and releases the protrusion 22, by the effect of the air pressure projected in the second body 6 and it moves it in the opposite direction to the outlet 3.

The pin 11, which is connected to the second body 6 by means of the holes 13, is dragged. The pin 11 also moves inside the slot 10 that belongs to the first body 5, from the upper part of the slot 10 to the lower part thereof. When the pin 11 reaches the lower end of the stroke thanks to the inner pressure caused by the air incoming from the inlets 2, 12, it drags the first body 5 downwards.

At the same time, the first body 5 descends and the second elastic means 7 (for example, a spring) is decompressed.

In this way, the cusp disk 18 and the disk 19 are detached from the outlet 3 and allow the air from the air inlets 2, 12 to exit through the outlet 3.

If this should be performed with the first joint 17 and the head 30, it would work similarly.

Once the first elastic means 8 ends its compression, it will tend to decompress again, searching for balance. When the first elastic means 8 decompresses again, it pushes the second body 6 towards the outlet 3.

When this happens, the second body 6 moves and allows the trigger 9 to rotate in its axis 26 until it is positioned underneath the protrusion 22, then blocking the trigger 9 to the protrusion 22, and therefore the second body 6, when the first elastic means 8 is compressed again.

When pushing the first elastic means 8 and the second body 6 two reactions occur: a first reaction is that the pin 11 reaches the upper end of the slot stroke 10 and it pushes it upwards, thus dragging the first body 5. The other reaction is that, when pushing the second body 6 and the second elastic means 7 upwards, the second elastic means 7 slides relatively to the second body 6 and a decompression reaction occurs by pushing the first body 5 towards the outlet 3.

The action described in the previous paragraph causes the cusp disk 18 of the first body 5 to block again the outlet 3, thus also blocking the air coming from the air inlets 2, 12. (FIGS. 2, 5-6)

If, on the contrary, the first joint 17 with the head 30 should be used, the same effect described above would occur, with the difference that the head 30 would block the outlet 3 and the first joint 17 would seal it (FIGS. 3-4).

In this configuration, when there is air pressure, the first body 5, which tends to go upwards (that is, towards the outlet 3) thanks to the second elastic means 7, ends up closing the outlet thanks to the air pressure that blocks the outlet 3 with the cusp disk 18 or the head 30. In turn, the second body 6, by the effect of the air pressure tends to go down (opposite to the outlet 3) and to lean on the trigger 9.

The present invention describes a new self-adjusting valve system for sporting air guns of the type that use PCP. The examples provided here are not limiting of the present invention, which may have different applications and/or adaptations, all of which within the scope of the following claims.

The invention claimed is:

1. Self-adjusting valve system for sporting air guns using PCP or pre-compressed air, comprising a trigger (9) having a support part (14), which defines a housing (1), comprising at least one air inlet (2,12), at least one outlet (3), characterised in that it comprises:

- a first body (5), as a valve, which blocks, when in a rest position, the air outlet (3);
- a second body (6), as a piston, which partially encloses the first body (5); said second body (6) being blocked by the trigger (9) when in a rest position;
- a first elastic means (8), arranged in the housing (1), between the second body (6) and the support part (14),
- a slot (10), formed in the first body (5), and
- a pin (11), which passes through the slot (10) and fits into certain holes (13) formed in the second body (6), whereas, when in a passive position, the first elastic means (8) pushes the second body (6) towards the outlet (3), and the second body (6) in turn pushes the first body (5) towards the outlet (3) and blocks said outlet (3), and the air pressure coming from the inlets (2,12) is projected towards the first body(5), thus contributing to the blocking of the outlet (3), and towards the second body (6), thus moving said second body in an opposite direction of the outlet; said second body (6) being thus blocked against the trigger (9);

and when in the active position, the trigger (9) rotates and releases the second body (6) which, by the effect of the air pressure projected in the second body (6) compresses the first elastic means (8) and moves said second body (6) in an opposite direction to the outlet (3); the pin (11) is moved by the slot (10) and when reaching the end of the stroke, said pin (11) drags the first body in an opposite direction to the outlet (3) and releases said outlet (3), letting out the pressure air from the inlets (2,12), and when the first elastic means (8) is decompressed, it drags the second body (6) towards the outlet (3) thus allowing the blocking of the trigger (9), pushing the first body (5) towards the outlet (3) and blocking the outlet (3).

2. The system according to claim 1, characterised in that it comprises a second elastic means (7), arranged inside the first body (5), between the first body (5) and the second body (6), separating the first body (5) from the second body (6), wherein, when in a passive position, the second elastic means (7) pushes the first body (5), against the outlet (3) and blocks it; and, when in the active position, the second elastic means is decompressed and releases the outlet (3) from where the pressure air from the inlets (2,12) exits; and, when the second elastic means (7) is compressed, it pushes the first body (5) towards the outlet (3) and blocks the outlet (3).

3. The system according to claims 2, characterised in that the first body (5) adopts a double-disk configuration, wherein a cusp disk (18) blocks the outlet (3) and a disk (19) is arranged outside the outlet (3).

4. The system according to claims 2, characterised in that the first body (5) comprises a head (30) delimited by a first joint (17), said head (30) facing the outlet (3) and blocking the outlet (3).

5. The system according to claims 3, characterised in that the second elastic means (7) is at least partially arranged at a first blind hole (20) formed in the second body (6).

6. The system according to claim 5, characterised in that the first body (5) is made of a plastic material.

7. The system according to claim 5, characterised in that the first body is made of metal.

8. The system according to claim 5, characterised in that—it comprises a first joint (4) in the housing (1), between the second body (6) and the frame (24).

9. The system according to claim 1, characterised in that the first elastic means (8) is at least partially arranged in a second blind hole (21) formed in a support part of the trigger (14).

10. The system according to claim 1, characterised in that the second body (6) comprises a protrusion (22) connected to the trigger (9).

11. The system according to claim 1, characterised in that the second body (6) comprises a slot connected to the trigger (9).

12. The system according to claim 10, characterised in that support part of the trigger (14) comprises a return means (23) for leading back the trigger (9) to its initial position.

13. The system according to claim 11, characterised in that support part of the trigger (14) comprises a return means (23) for leading back the trigger (9) to its initial position.

* * * * *